US008485785B2

(12) United States Patent
Garner et al.

(10) Patent No.: US 8,485,785 B2
(45) Date of Patent: Jul. 16, 2013

(54) WEAR PREVENTION SPRING FOR TURBINE BLADE

(75) Inventors: Chad M. Garner, Orlando, FL (US); Barton M. Pepperman, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 1142 days.

(21) Appl. No.: 11/879,923

(22) Filed: Jul. 19, 2007

(65) Prior Publication Data

US 2009/0022594 A1 Jan. 22, 2009

(51) Int. Cl.
*F01D 5/30* (2006.01)
*F01D 5/16* (2006.01)

(52) U.S. Cl.
USPC ..... 416/221; 416/500

(58) Field of Classification Search
USPC ..... 416/193 A, 220 R, 221, 239, 248
See application file for complete search history.

(56) References Cited

U.S. PATENT DOCUMENTS

| | | | | |
|---|---|---|---|---|
| 2,843,356 | A | 7/1958 | Hull, Jr. | |
| 2,867,408 | A | 1/1959 | Kolb et al. | |
| 2,942,842 | A * | 6/1960 | Hayes | 416/221 |
| 3,112,914 | A | 12/1963 | Wellman | |
| 3,730,640 | A * | 5/1973 | Rice et al. | 415/117 |
| 3,930,751 | A | 1/1976 | Straslicka et al. | |
| 4,102,602 | A | 7/1978 | Rottenkolber | |
| 4,208,170 | A | 6/1980 | Tucker et al. | |
| 4,457,668 | A * | 7/1984 | Hallinger | 416/95 |
| 4,474,535 | A | 10/1984 | Dhuic | |
| 4,478,554 | A | 10/1984 | Surdi | |
| 4,621,976 | A * | 11/1986 | Marshall et al. | 415/191 |
| 4,897,021 | A | 1/1990 | Chaplin et al. | |
| 5,123,813 | A | 6/1992 | Przytulski et al. | |
| 5,242,270 | A | 9/1993 | Partington et al. | |
| 5,350,279 | A | 9/1994 | Prentice et al. | |
| 5,429,479 | A * | 7/1995 | Cordier | 415/209.3 |
| 5,518,369 | A * | 5/1996 | Modafferi | 416/193 A |
| 6,267,557 | B1 * | 7/2001 | Chin | 416/190 |
| 6,447,253 | B2 | 9/2002 | Tempere | |
| 6,527,274 | B2 | 3/2003 | Herron et al. | |
| 7,291,946 | B2 * | 11/2007 | Clouse et al. | 310/51 |
| 2005/0207892 | A1 | 9/2005 | Kanebako et al. | |

* cited by examiner

*Primary Examiner* — Nathaniel Wiehe
*Assistant Examiner* — Sean J Younger

(57) ABSTRACT

A turbine airfoil support system for supporting a turbine blade to prevent wear during turning gear operation when a rotor assembly supporting the turbine blade rotates at about two revolutions per minute (RPM) to keep the turbine ready for quick startup requirements. The turbine airfoil support system may be formed from a radial biasing spring positioned between a radially outermost point of a disk steeple extending from a rotor assembly and a radially inner surface of the platform. The radial biasing spring may be formed from a first flat member with a disk steeple engaging surface, a second flat member with a blade platform engaging surface, a bent biasing section extending from the first flat member to the second flat member and biasing the first and second flat members away from each other, and a stress reducing member extending from the second flat member toward the first flat member.

9 Claims, 1 Drawing Sheet

WEAR PREVENTION SPRING FOR TURBINE BLADE

FIELD OF THE INVENTION

This invention is directed generally to turbine airfoils, and more particularly to support systems for hollow turbine airfoils usable in turbine engines.

BACKGROUND

Typically, gas turbine engines include a compressor for compressing air, a combustor for mixing the compressed air with fuel and igniting the mixture, and a rotor assembly for producing power. The rotor assembly is formed from a plurality of turbine blades extending radially outward from a rotor. Each turbine blade is formed from a root portion having a platform at one end and an elongated portion forming a blade that extends outwardly from the platform. The blade is ordinarily composed of a tip opposite the root section, a leading edge, and a trailing edge. The root typically is attached to a disk of the rotor assembly with a plurality of serrations extending from the disk that mesh with a plurality of serrations extending from the disk to fixedly attach the blade to the rotor. While the turbine blade is fixedly attached to the rotor, there typically exists sufficient play in the attachment mechanism that the turbine blade may move.

During use, the rotor, in one particular turbine engine, rotates at about 3600 revolutions per minute (RPM). In this operating mode, the centrifugal forces created cause the turbine blades to extend radially outward without any movement relative to the rotor assembly to which the turbine blades are attached. However, in another mode in which the rotor is rotated very slowly by a turning gear, such as about 2 RPM, the turbine blades rock back and forth causing wear as the rotor is turned slowly. In particular, many turbine engines are kept in a ready state through use of turning gears that enable a turbine engine to be quickly brought to steady state operating conditions. In some situations, turbine engines are run with a turning gear for long periods, such as for several continuous months. At such a slow RPM, gravitational forces are stronger than centrifugal forces, thereby causing the turbine blades to rock back and forth, causing turbine blade root serration wear on both the rotor serrations and the blade root serrations as well. The rocking motion also causes hard face coating damage on shrouded turbine blades and, in some instances, has caused rotor cracking.

The wear caused by the rocking action of the turbine blades also frustrates efforts to take blade tip readings as well. In particular, when blade tip readings are performed in the field, the operator must physically lift or wedge each blade into the running position while taking the blade tip reading. Lifting each turbine blade by hand takes time and often results in inaccurate blade tip readings.

Previous attempts to curb root serration wear have been attempted but have not been successful. For instance, seal pin slots on the turbine blades have been enlarged and larger pins have been used. However, the turbine blade serrations have continued to wear resulting in rotor repair and scrapping of the turbine blades. Thus, a need exists for reducing wear on turbine blade root serrations.

SUMMARY OF THE INVENTION

This invention relates to a turbine airfoil support system for supporting a turbine blade to prevent wear during turning gear operation when a rotor assembly supporting the turbine blade rotates slowly, such as, at about two revolutions per minute (RPM), to maintain the turbine engine ready for quick startup requirements. The turbine airfoil support system may be formed from a radial biasing spring positioned between a radially outermost point of a disk steeple extending from the rotor assembly and a radially inner surface of a platform. The radial biasing spring may be configured to bias the turbine blade radially outward to substantially reduce, or eliminate entirely, wear caused during turning gear operation by eliminating turbine blade movement.

The turbine airfoil support system may include a rotor assembly formed from one or more disk steeples extending radially outward from a rotational axis of the rotor assembly. The disk steeples may include a plurality of lateral serrations extending laterally from each of the disk steeples to retain a generally elongated, turbine airfoil in position. The turbine airfoil support system may also include a generally elongated, hollow airfoil having a leading edge, a trailing edge, a tip section at a first end, a root coupled to the airfoil at an end generally opposite the first end for supporting the airfoil and for coupling the airfoil to the disk steeple, and a platform extending generally orthogonally from the generally elongated, hollow airfoil at the intersection between the root and the leading edge. The turbine airfoil support system may include a radial biasing spring positioned between a radially outermost point of the disk steeple and a radially inner surface of the platform. The radial biasing spring may be formed from a first flat member with a disk steeple engaging surface, a second flat member with a blade platform engaging surface, and a bent biasing section extending from the first flat member to the second flat member and biasing the first and second flat members away from each other.

The turbine airfoil support system may also include a stress reducing member extending from an end of the second flat member toward the first flat member of the radial biasing spring. The stress reducing member prevents the first flat member from being moved into contact with the second flat member when subjected to centrifugal force loads. As such, the radial biasing spring retains the original shape and is not subjected to undue stress. The stress reducing member may terminate within 0.125 inches of the first flat member. In one embodiment, the stress reducing member is formed from a flat member. In addition, the first and second flat members, the bent biasing section and the stress reducing member may be a unitary structure and may have substantially equal widths.

During use, the radial biasing spring may be positioned between the platform and the disk steeple and may impart a force radially outward on the platform, thereby forcing the turbine blade radially outward. The radial biasing spring forces the turbine blade outward with enough force to prevent the turbine blade from rocking in the attachment when the rotor assembly is being rotated by the turning gear, but not too much force that exceeds allowable stresses in the rotor assembly or blade root serrations. During steady state operating conditions, the radial biasing spring remains in position and does not effect the normal operation of the turbine engine even though the radial biasing springs add a relatively small load to the rotor assembly.

An advantage of this invention is that the radial biasing spring retains a turbine blade in an operating position by preventing the turbine blade from rocking in the attachment when the rotor assembly is rotated by a turning gear at very low RPMs.

Another advantage of this invention is that the radial biasing spring eliminates wear caused by rocking turbine blades when the rotor assembly is being turned at about two RPM by a turning gear, thereby increasing the useful life of the turbine blades.

Still another advantage of this invention is that the radial biasing springs eliminate the need for an operator to lift the turbine blades to take blade tip measurements because the tubing blades remain in the operating position, thereby reducing the measurement time and makes more accurate blade tip readings possible.

These and other embodiments are described in more detail below.

BRIEF DESCRIPTION OF THE DRAWINGS

The accompanying drawings, which are incorporated in and form a part of the specification, illustrate embodiments of the presently disklosed invention and, together with the description, disklose the principles of the invention.

DETAILED DESCRIPTION OF THE INVENTION

Figure 2:
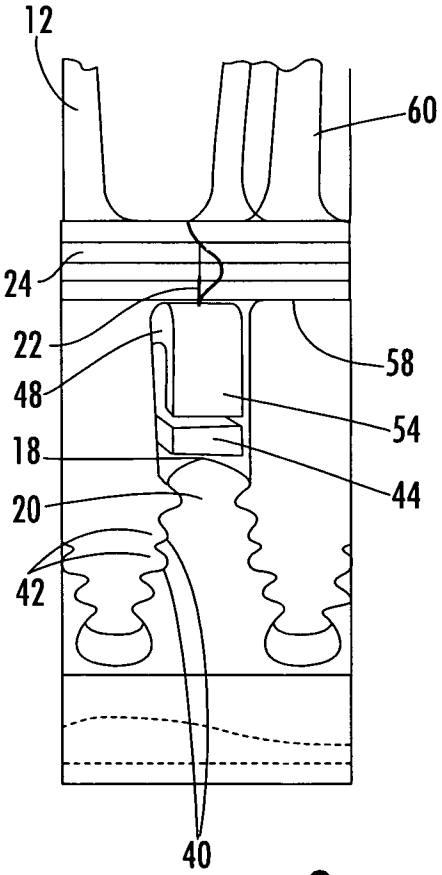
FIG. 2 is a front view of the rotor assembly of FIG. 1 with turbine airfoils extending from the rotor assembly and maintained in position with a radial biasing spring between a platform and a disk steeple.
Figure 1:
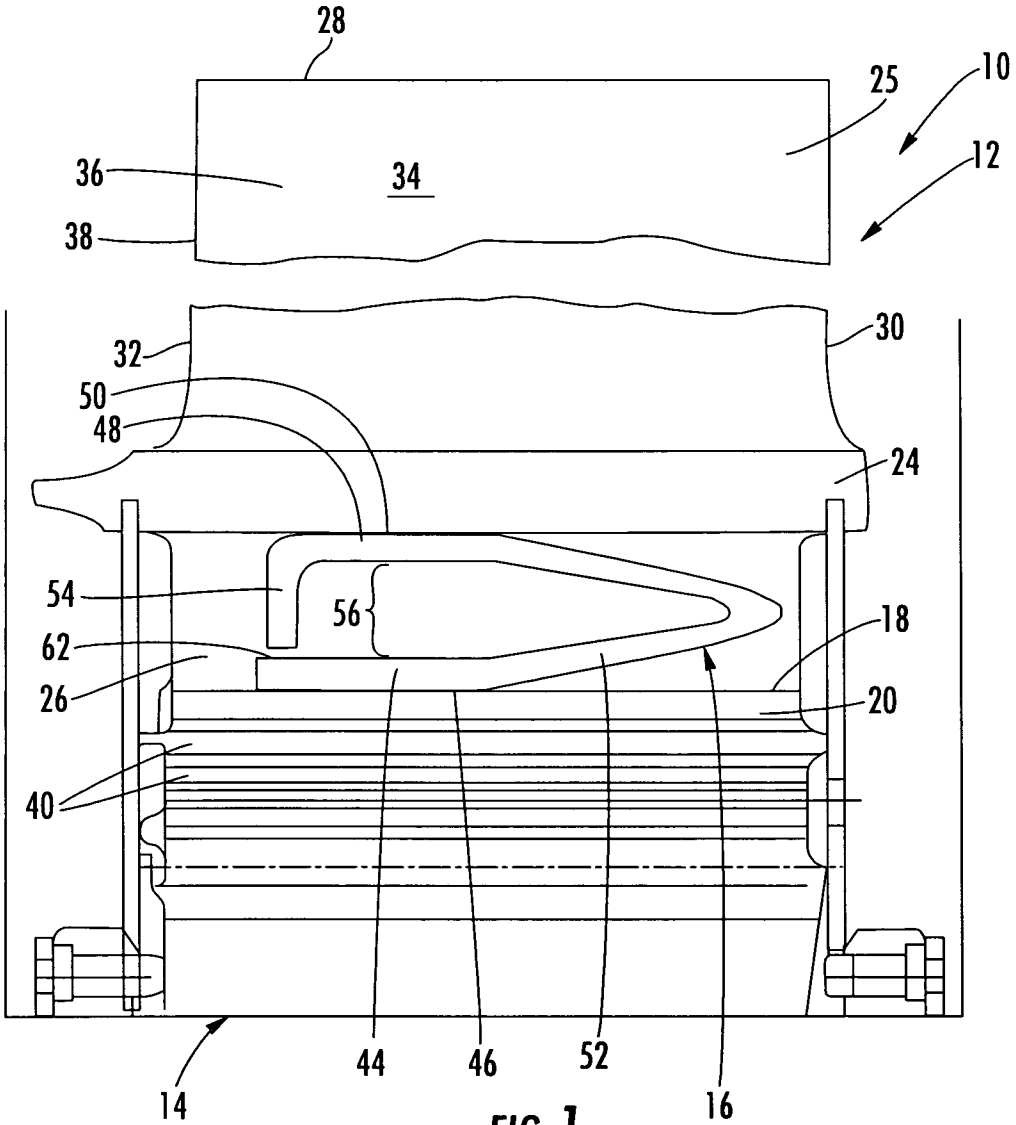
FIG. 1 is a side view of a turbine airfoil attached to a rotor assembly with a turbine blade support system of the instant invention.

As shown in FIGS. 1-2, this invention is directed to a turbine airfoil support system 10 for supporting a turbine blade 12 to prevent wear during turning gear operation when a rotor assembly 14 supporting the turbine blade 12 rotates slowly, such as, at about two revolutions per minute (RPM), to keep the turbine engine ready for quick startup requirements. The turbine airfoil support system 10 may be formed from a radial biasing spring 16 positioned between a radially outermost point 18 of a disk steeple 20 extending from the rotor assembly 14 and a radially inner surface 22 of a platform 24. The radial biasing spring 16 may be configured to bias the turbine blade 12 radially outward to substantially reduce, or eliminate entirely, wear caused during turning gear operation.

As shown in FIG. 1, the turbine blade 12 may be formed from a generally elongated, hollow airfoil 25 coupled to a root 26 at a platform 24. The turbine airfoil 12 may be formed from conventional metals or other acceptable materials. The generally elongated airfoil 25 may extend from the root 26 to a tip section 28 and include a leading edge 30 and trailing edge 32. Airfoil 24 may have an outer wall 34 adapted for use, for example, in a first stage of an axial flow turbine engine. Outer wall 34 may form a generally concave shaped portion forming a pressure side 36 and may form a generally convex shaped portion forming the suction side 38. The cooling system 12 of the turbine airfoil 10 may include a cavity (not shown) positioned in inner aspects of the airfoil 25 for directing one or more gases, which may include air received from a compressor (not shown), through the airfoil 25 to reduce the temperature of the airfoil 25. The cavity may be arranged in various configurations and is not limited to a particular flow path. The platform 24 may be positioned at the intersection of the root 26 and the leading edge 30. In one embodiment, the platform 24 may extend generally orthogonally to the generally elongated, hollow airfoil 25.

The disk steeple 20 may include a plurality of serrations 40 extending laterally from the steeple 20 to mesh with serrations 42 on the root 26 of the turbine blade 12 to facilitate attachment of the root 26 to the rotor assembly 14. The serrations 40 on the disk steeple 20 may protrude generally orthogonal to a radial axis extending from the rotor assembly 14. The serrations 40 may be configured to prevent movement radially outwardly by the turbine blade 12.

As shown in FIG. 1, the radial biasing spring 16 may be formed from a first flat member 44 with a disk steeple engaging surface 46, a second flat member 48 with a blade platform engaging surface 50, a bent biasing section 52 extending from the first flat member 44 to the second flat member 48 and biasing the first and second flat members 44, 48 away from each other, and a stress reducing member 54 extending from the second flat member 48 toward the first flat member 44. The radial biasing spring 16 may be configured such that the first and second flat members 44, 48 are separated by a gap 56. The gap 56 exists because of a lack of material between the first and second flat members 44, 48, thereby resulting in a reduced load on the rotor assembly 14 as compared with solid biasing devices. The bent biasing section 52 may be generally V-shaped. The bent biasing section 52 may be configured such that the that the size of the gap 56 is greater than a distance between the radially inner surface 22 of the platform 24 and the radially outermost point 18 on the disk steeple 20. When moved into position, the bent biasing section 52 may be bent so that the radial biasing spring 16 may fit between the platform 24 and the disk steeple 20. As such, the bent biasing section 52 imparts a force on the platform 24 to keep the platform 24 biased radially outward from the rotor assembly 14 through all levels of operation and at rest. Thus, the bent biasing section 52 pushes the turbine blade 12 radially outward during prolonged periods of slow rotation of the rotor assembly 14.

The radial biasing spring may be formed from one or more members assembled together. In one embodiment, as shown in FIG. 1, the radial biasing spring 16 may be formed from a unitary structure composed of the first flat member 44, the second flat member 48, the bent biasing section 52, and the stress reducing member 54. In addition, the first and second flat members 44, 48, the bent biasing section 52 and the stress reducing member 54 may have a substantially equal width, as shown in FIG. 2. As shown in FIG. 1, the stress reducing member 54 may be formed from a flat member.

As shown in FIG. 1, the stress reducing member 54 may be attached to an end of the second flat member 48 and may extend generally orthogonally to the second flat member 48 and terminate in close proximity to the first flat member 48, leaving a gap 62. In at least one embodiment, the stress reducing member 54 may terminate within about 0.125 inches of the first flat member.

During use, the radial biasing spring 16 may be positioned between the platform 24 and the disk steeple 20 when assembling new components or when repairing previously existing turbine engines during has gas path inspection outage. In one embodiment, a radial biasing spring 16 may bias two adjacent turbine airfoils. For instance, the second flat member 48 may engage the platform 24 extending generally orthogonally from the generally elongated, hollow airfoil 25 and a second platform 58 extending generally orthogonally from a second generally elongated, hollow airfoil 60 that is adjacent to the generally elongated, hollow airfoil 25. The radial biasing spring 16 may apply forces radially outward to the platform 24 extending generally orthogonally from the generally elongated, hollow airfoil 25 and to the second platform 58. In one embodiment, the radial biasing spring 16 may apply equal forces to the first platform 24 and to the second platform 58. The radial biasing spring 16 may be positioned between the platform 24 and the disk steeple 20 before conventional locking hardware is installed. The locking hardware may then be installed. Radial biasing springs 16 may be positioned adjacent to one or more turbine blades 12 attached to the rotor assembly 14. In one embodiment, radial biasing springs 16 may be positioned under each turbine blade 12 extending from the rotor assembly 14.

The radial biasing spring 16 remains in place in the turbine engine during all modes of operation. While the turbine engine is operating in a turning gear mode, in which a turning gear (not shown) is rotating the rotor assembly at about 2 RPM, the radial biasing spring 16 biases the blade 12 radially outward in the running position and does not allow movement of the turbine blade 12 caused by gravitational forces. The radial biasing spring 16 holds the turbine blade 12 outward with enough force to prevent the turbine blade 12 from rocking in the attachment when the rotor assembly 14 is being rotated by the turning gear, but not too much force that exceeds allowable stresses in the rotor assembly 14 or blade root serrations 42.

During steady state operating conditions, the radial biasing spring 16 remains in position and does not effect the normal operation of the turbine engine even though the radial biasing springs 16 add a relatively small load to the rotor assembly. The stress reducing member 54 of the radial biasing spring 16 prevents centrifugal forces developed during steady state operation of the turbine engine, such as about 3600 RPM, from overstressing the radial biasing spring 16. In particular, the stress reducing member 54 prevents the first flat member 44 from being moved into contact with the second flat member 48 when subjected to centrifugal force loads. As such, the radial biasing spring 16 retains the original shape and is not subjected to undue stress.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil support system, comprising:

a rotor assembly formed from at least one disk steeple extending radially outward from a rotational axis of the rotor assembly, wherein the at least one disk steeple includes a plurality of lateral serrations extending laterally from the at least one disk steeple to retain a generally elongated, turbine airfoil in position;

the generally elongated, hollow airfoil having a leading edge, a trailing edge, a tip section at a first end, a root coupled to the airfoil at an end generally opposite the first end for supporting the airfoil and for coupling the airfoil to the at least one disk steeple, and a platform extending generally orthogonally from the generally elongated, hollow airfoil at the intersection between the root and the leading edge;

a radial biasing spring positioned between a radially outermost point of the at least one disk steeple and a radially inner surface of the platform;

wherein the radial biasing spring is formed from a first flat member with a disk steeple engaging surface, a second flat member with a blade platform engaging surface, and a bent biasing section extending from the first flat member to the second flat member and biasing the first and second flat members away from each other and into contact with the platform and the at least one disk steeple, wherein an end of the first flat member opposite the biasing section is axially aligned with an end of the second flat member; and a stress reducing member extending from the end of the second flat member toward the end of the first flat member such that the stress reducing member extends generally orthogonally to the second flat member and terminates in close proximity to the first flat member such that centrifugal forces developed during steady state operation of the turbine engine causes the stress reducing member to contact the first flat member in close proximity to an end of the first flat member and allow only limited movement, thereby enabling the radial biasing spring to retain its shape and not be subjected to undue stress.

2. The turbine airfoil support system of claim 1, wherein the stress reducing member is formed from a flat member.

3. The turbine airfoil support system of claim 2, wherein the stress reducing member terminates within 0.125 inches of the first flat member.

4. The turbine airfoil support system of claim 1, wherein the first and second flat members, the bent biasing section and the stress reducing member are a unitary structure.

5. The turbine airfoil support system of claim 4, wherein the first and second flat members, the bent biasing section and the stress reducing member have a substantially equal widths.

6. The turbine airfoil support system of claim 1, wherein the second flat member engages the platform extending generally orthogonally from the generally elongated, hollow airfoil and a second platform extending generally orthogonally from a second generally elongated, hollow airfoil that is adjacent to the generally elongated, hollow airfoil, wherein the radial biasing spring applies forces radially outward to the platform extending generally orthogonally from the generally elongated, hollow airfoil and to the second platform.

7. A turbine airfoil support system, comprising:

a rotor assembly formed from at least one disk steeple extending radially outward from a rotational axis of the rotor assembly, wherein the at least one disk steeple includes a plurality of lateral serrations extending laterally from the at least one disk steeple to retain a generally elongated, turbine airfoil in position;

the generally elongated, hollow airfoil having a leading edge, a trailing edge, a tip section at a first end, a root coupled to the airfoil at an end generally opposite the first end for supporting the airfoil and for coupling the airfoil to the at least one disk steeple, and a platform extending generally orthogonally from the generally elongated, hollow airfoil at the intersection between the root and the leading edge;

a radial biasing spring positioned between a radially outermost point of the at least one disk steeple and a radially inner surface of the platform; and wherein the radial biasing spring is formed from a first flat member with a disk steeple engaging surface, a second flat member with a blade platform engaging surface, a bent biasing section extending from the first flat member to the second flat member and biasing the first and second flat members away from each other and into contact with the platform and the at least one disk steeple, wherein an end of the first flat member opposite the biasing section is axially aligned with an end of the second flat member;

a flat stress reducing member coupled to and extending from the end of the second flat member toward the first flat member such that the stress reducing member extends generally orthogonally to the second flat member and terminates in close proximity to the first flat member such that centrifugal forces developed during steady state operation of the turbine engine causes the stress reducing member to contact the first flat member in close proximity to an end of the first flat member and allow only limited movement, thereby enabling the radial biasing spring to retain its shape and not be subjected to undue stress; and wherein the first and second flat members, the bent biasing section and the stress reducing member are a unitary structure.

8. The turbine airfoil support system of claim 7, wherein the stress reducing member terminates within 0.125 inches of the first flat member.

9. The turbine airfoil support system of claim 7, wherein the first and second flat members, the bent biasing section and the stress reducing member have a substantially equal width.

* * * * *